United States Patent [19]

Tomsa

[11] Patent Number: 4,512,623

[45] Date of Patent: Apr. 23, 1985

[54] ELECTRICAL CONNECTOR ASSEMBLY HAVING MEANS FOR SHIELDING ELECTROMAGNETIC INTERFERENCE

[75] Inventor: Vladimir Tomsa, Chicago, Ill.

[73] Assignee: Allied Corporation, Morristown, N.J.

[21] Appl. No.: 576,684

[22] Filed: Feb. 3, 1984

[51] Int. Cl.[3] ..... H01R 13/653

[52] U.S. Cl. ..... 339/143 R; 29/876

[58] Field of Search ..... 29/876; 339/143 R, 251, 339/256 RT, 255 RT

[56] References Cited

U.S. PATENT DOCUMENTS 4,239,318 12/1980 Schwartz ..... 339/143 R 4,276,523 6/1981 Boutros et al. ..... 339/143 R X

FOREIGN PATENT DOCUMENTS 2025158 1/1980 United Kingdom ..... 339/143 R

*Primary Examiner*—Eugene F. Desmond

*Attorney, Agent, or Firm*—C. D. Lacina

[57] ABSTRACT

A closed, radially contractible, metallic annular spring band (20) is radially interposed between mating plug and receptacle shells (10, 40) to shield electromagnetic signals from entering or leaving the assembly, the plug shell (10) including an annular groove (14) circumposed by annular lips (16, 18) which define annular undercuts (17, 19) therearound to receive and captivate the spring band contracted therein. The spring band includes flat margins (22) which extend into the undercuts, an arcuate section (24) between the margins having an arcuate cross-section which extends radially upward from the annular groove a distance sufficient to be compressed by the receptacle shell during mating, and a plurality of alternating slots (26) opening along opposite edges (21, 23) thereof to define alternating segments (28) which overlappingly fold over one on to the other to close the slots (26) when the band (20) is contracted, the band initially being of greater diameter than the plug (10) and the arcuate section (24) being adapted to radially flatten during mating.

11 Claims, 13 Drawing Figures

FIG. 1
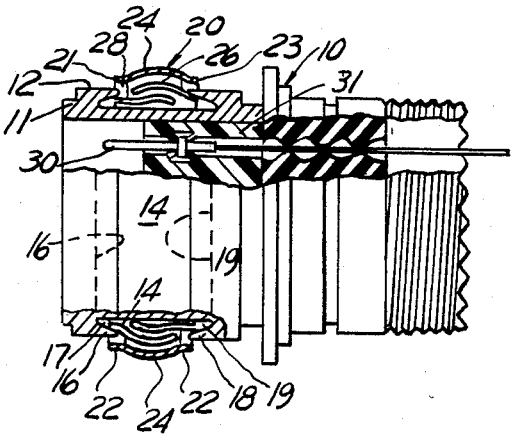
FIG. 2
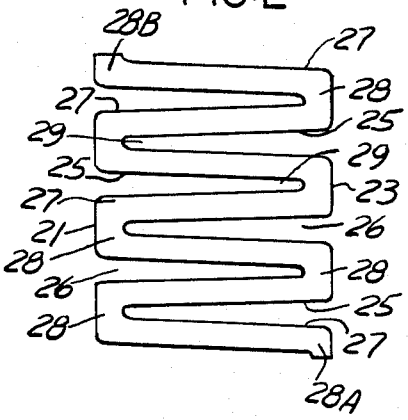
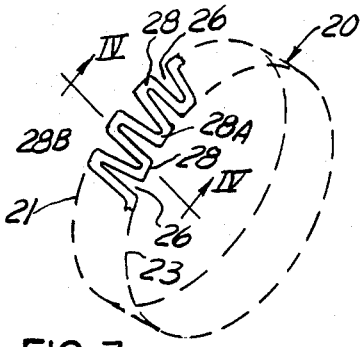
FIG. 3
FIG. 4
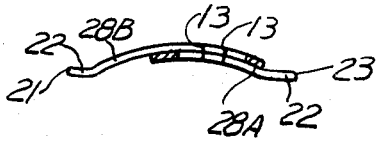
FIG. 5
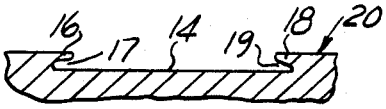
FIG. 6
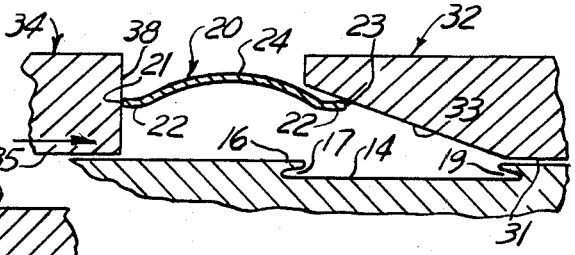
FIG. 7
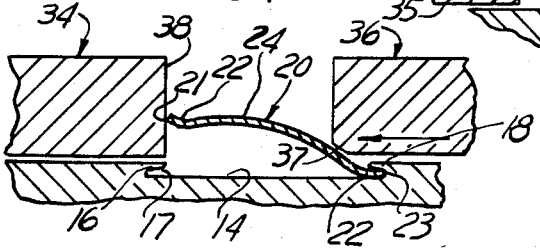

FIG. 8
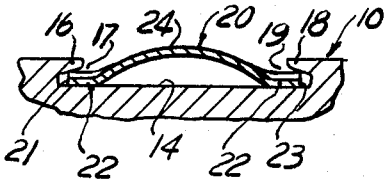
FIG. 9
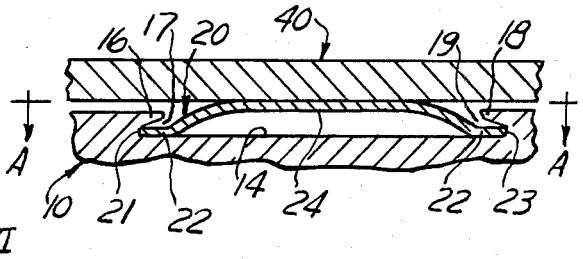
FIG. 10
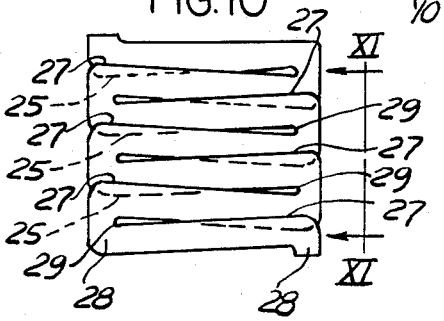
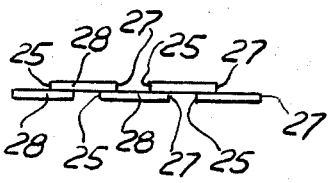
FIG. 13
FIG. 12
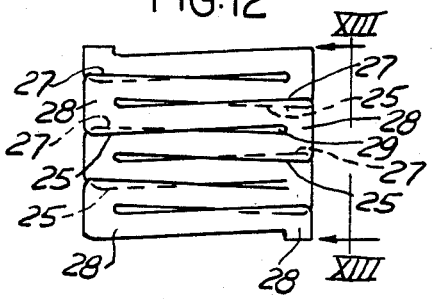
FIG. 11
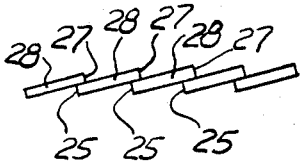

ELECTRICAL CONNECTOR ASSEMBLY HAVING MEANS FOR SHIELDING ELECTROMAGNETIC INTERFERENCE

This invention relates to an electrical connector assembly having means for shielding the assembly from electromagnetic interference.

An annular, radially compressible, metallic spring band of arcuate cross-section is radially interposed between the mating halves of a connector assembly to shield electromagnetic and radio frequency signals (RFI, EMI) or electromagnetic pulses (EMP) from entering or leaving the assembly. U.S. Pat. No. 3,466,590 issuing Sept. 9, 1969 to Sylvester for "Grounding Device in an Electrical Connector" shows an annular undercut encircling one of the connector shells receiving a spring band having its ends free and a plurality of transverse slots stopping short of its opposite edges, the slots possibly being spread circumferentially when the band annulus is compressed by the mating shell. U.S. Pat. No. 4,239,318 issuing Dec. 16, 1982 to Schwartz for "An Electrical Connector Shield" and U.S. Pat. No. 4,326,768 issuing Apr. 27, 1982 to Punako for "An Electrical Connector" show a closed annular band which is stamped with, respectively, either alternating slits or alternating slots which open along opposite edges of the band to provide a chain of segments, the inner diameter of each band, respectively, being less than and equal to an outer diameter of the shell to which mounted. Schwartz teaches that slots which open circumferentially do not adequately eliminate electromagnetic interference and thus the alternating slits were intended to provide slots which have "zero" width when the band is compressed but which spread to allow the band to radially expand to a diameter greater than the diameter of the shell to which it is to be mounted, whereby mounting causes alternating segments of the band to diverge from their side-by-side abutment. Prevention of circumferential gaps is dependent upon the manufacturing precision of the circumference dimension of both the band and the outer surface of its associated shell and of the diameter of both the band radial extension and the inner surface of the mating shell. During mating, radial compression force by the mating shell against the band arcuate section may not restore the segments into their side-by-side abutment and assure substantial metal-to-metal contact between the segment and the mating shell.

A more desirable spring band would contact the largest surface area of the mating shell as is possible, minimize circumferential gaps between segments, and have adequate spring elastically to assure contact between mated connector halves. By contacting the largest surface area, drainage of electrical potential from shell-to-shell is enhanced. By elimination of circumferential gaps between segments, leakage of electromagnetic radiation therethrough will be reduced.

This invention is an electrical connector assembly of the type having mateable plug and receptacle shells and an annular spring band for shielding the assembly from entry or leakage of electromagnetic energy, the spring band annulus being disposed in an annular groove about the plug shell and adapted to be radially compressed upon mating by the receptacle shell. The spring band is stamped from a resilient metal to include alternating slots opening along opposite edges thereof and formed into an annulus including a convexly curved arcuate section. The invention is characterized by the annular groove being circumposed by a pair of annular lips defining longitudinally spaced annular undercuts for captivating the opposite edges of the band; and the spring band describing a closed radially contractible annulus, the annulus being greater in diameter than the outer diameter of the plug shell for mounting thereto and capable of radially contracting into the groove thereabout. The band includes flat margins terminating in each lateral edge of the band and the convexly curved, arcuate section medial thereto, each flat margin being received in one of the respective undercuts and the arcuate section being dimensioned to extend radially from the plug shell to be compressed by the receptacle shell. Upon assembly to the plug shell, the segments of the band overlap one onto the other and the slots close. Upon mating of the connector shells, the receptable shell engages the arcuate section whereby the flat margins firmly abut with the undercuts and the arcuate section flattens against the receptacle.

The advantage of this invention is provision of a metallic annular shield band that develops a large surface of metal-to-metal contact, eliminates cracks from forming in the material because the band is not stretched during assembly, eliminates spring-gripping when the connectors are being decoupled because the band is fixed on both sides, and reduces circumferential separation between the slots by radial compression of segments into overlapping relation. An annulus which is dimensioned to slide over the plug shell into an annular groove therearound does not distort and is easily inserted into undercuts in the groove by radial compression, the undercuts protecting the edges of the spring annulus from scratch marks and preventing wear on the finish of the shells.

One way of carrying out the invention is described in detail below with reference to the drawings which illustrate a specific embodiment of this invention, in which:

FIG. 1 is a side view, partially in section, of a connector plug shell with an annular spring band positioned therearound prior to fitment thereto.

FIG. 2 is a plan view of a portion of the band prior to being formed into an annulus.

FIG. 3 is a perspective view of the annulus after forming and the last segments of the band joined together.

FIG. 4 is a cross-section of the band taken along lines IV—IV of FIG. 3.

FIG. 5 is a partial side view, in section, of an annular undercut around the plug shell of FIG. 1.

FIGS. 6, 7 and 8 show assembly of the band to the shell.

FIG. 9 is a partial side view, in section, of the band when compressed by a receptacle shell during mating with the plug shell.

FIG. 10 is a plan view of a portion of the compressed band configuration taken along lines A—A of FIG. 9.

FIG. 11 is a cross-section of the band taken along lines XI—XI of FIG. 10.

FIG. 12 is a plan view of an alternate compressed band configuration taken along lines A—A of FIG. 9.

FIG. 13 is a cross-section of the band taken along lines XIII—XIII of FIG. 12.

Referring now to the drawings, FIG. 1 shows a closed, radially contractible, annular spring band 20 disposed about a connector plug shell 10, the plug shell having a generally cylindrical barrel or forward mating end 11 and including a plurality of axial keys 12 for orienting a mating receptacle shell 40 (see FIG. 9) and constraining the shells to advance without rotation along a common axis. Typically the plug shell carries a plurality of pin contacts 30 in a dielectric insert 31 for mating with a like plurality of socket contacts (not shown) in the receptacle shell. Of course, the contacts could be other than pin/socket.

Plug shell 10 includes an annular groove 14 encircled by a forward annular lip 16 and a rearward annular lip 18, the annular groove being adapted to receive spring band 20 and including a circumferential surface substantially concentric with the axis of the plug shell and the lips 16, 18 defining a pair of axially spaced annular undercuts 17, 19 for seating spring band 20 therewithin. Each annular undercut is defined by an annular side wall the surface of which tapers radially outward from the groove circumferential surface to the outer surface of the plug shell.

Spring band 20 defines an annulus having an inner diameter which is sized to clearance fit about forward mating end 11 of plug shell 10 when the annulus is in its free (i.e., uncontracted) condition and adapted to be radially contracted into an interference fit within annular groove 14, the band having flat margins 22 along and terminating at its opposite edges 21, 23, an arcuate section 24 medially thereto and contiguous with the flat margins, and a plurality of transverse alternating slots 26 which open along the opposite edges 21, 23 to define a chain of segments 28.

FIG. 2 shows a portion of spring band 20, the band being stamped from a flat piece of beryllium copper (or other suitable electrically conductive resilient metal) and including alternating slots 26 which open to opposite edges 21, 23, each slot being defined by spaced sidewalls 25, 27 which taper inwardly to a common root 29.

FIG. 3 shows a perspective of spring band 20 formed into the closed annulus and provided with flat margins 22 adjacent its opposite edges 21, 23, the arcuate section 24 intermediate the flat margins, and the opposite ends 28A, 28B of the band being welded together, the flat margins 22 describing a circumferential surface having an interior diameter greater than the outer diameter of plug shell 10 to which the band is to be telescoped about.

FIG. 4 shows a section of the annulus and spring band 20 wherein a portion of the segment 28A at one end of the band is joined by spot welding 13 with a portion of the other segment 28B at the other end of the band.

FIG. 5 shows detail of annular groove 14, forward annular lip 16 and its associated undercut 17, and rearward annular lip 18 and its associated undercut 19.

FIGS. 6, 7 and 8 show assembly fixtures 32, 34 and 36 for assembling spring band 20 to plug shell 10 and assembly of the spring band annulus into annular groove 14. FIG. 6 shows first assembly fixture 32 as including an inner wall 31 sized to telescope about forward mating end 11 of plug shell 10 and a frusto-conical wall 33 tapering radially outwardly therefrom to define a funnel-like opening for receiving the spring band and for funneling the spring band radially inward and into the annular groove, the line where inner wall 31 intersects with frusto-conical wall 33 being positioned circumjacent rearward annular lip 19. First assembly fixture 32 comprises a pair of thick walled semi-circular rings having axial keyways on their inner walls angularly disposed with the same arrangement as axial keys 12 on the plug shell 10 to allow positioning of the rings thereabout, radially combining the semi-circular rings closing the rings assembling the fixture thereabout.

The second assembly fixture 34 includes an inner wall 35 sized to telescope about forward mating end 11 of plug shell 10 and a transverse end face defining a shoulder 38 for bearing against one edge 21 of the band and pushing the other edge 23 of the band into the funnel opening.

FIG. 7 shows second assembly fixture 34 advancing axially rearward from the forward end face of the plug shell towards first assembly fixture 32 until shoulder 38 reaches the edge of forward lip 16. As a result of rearward movement of second assembly fixture 34, the annulus is contracted radially inward by the funnel until the other edge 23 thereof snaps under the rearward undercut 19. First assembly fixture 32 is then removed and replaced by third assembly fixture 36.

Third assembly fixture 36 is similar to first assembly fixture 32 and comprises a pair of thick walled semi-circular rings having axial keyways on the inner walls angularly disposed with the same arrangement as axial keys 12 around the plug shell to allow their being positioned thereabout, the third assembly fixture 36 also including a steeply tapered frusto-conical throat 37 for camming against arcuate section 24. The third assembly fixture 36, when advanced axially forward towards second assembly fixture 34, contracts the annulus radially inward and the edge 21 snaps under the forward undercut 17.

FIG. 8 shows spring band 20 radially contracted within annular groove 14 such that the opposite edges 21, 23 of its flat margins 22 are laterally spaced from the sidewalls forming the annular undercuts and the uppermost portion of its arcuate section is disposed above the outer surface of the plug shell, the arcuate section 24 being convexly curved relative to annular groove 14. The radial width of each annular groove around the plug shell is dimensioned to receive double material thickness of the spring band segments so that the band segments may overlap each other. For reasons of keeping elasticity in the spring, lateral separation between the edges 21, 23 of flat margins 22 and the respective undercuts 17, 19 prior to receptacle mating is desirable.

FIG. 9 shows a receptacle shell 40 having its interior wall 42 telescoped about plug shell 10. Spring band 20 has its arcuate section 24 compressed radially inward to "bottom" around and flatten against the inner surface of the shell. Because the annulus was initially greater in diameter than that of plug shell 10, radial contraction of the annulus will cause adjacent segments 28 to overlap one another as shown by FIG. 10 or 12.

FIGS. 10 and 11 show unwanted slots 26 between adjacent segments 28 being closed by respective segments alternatingly being layered above and below one another.

FIGS. 12 and 13 show unwanted slots 26 between adjacent segments 28 being closed by respective segments being stacked onto one another, the stacking causing each segment to have its side walls 27 define a leading edge and its side walls 25 define a trailing edge with each leading edge climbing up and onto the trailing edge of its next succeeding segment.

I claim:

1. An electrical connector assembly comprising a plug connector member including a barrel telescoped into a shell of a receptacle connector member, said barrel including an annular groove therearound circumposed by the shell, a plurality of mated contacts therein, and shielding means disposed between the outer surface of said barrel and the inner surface of said shell for shielding said contacts from radio frequency interference, said shielding means comprising an annular band of arcuate cross-section being disposed in said groove, said band being stamped from a resilient metal and having alternating slots therein opening at opposite edges thereof to define a succession of segments, said shielding means characterized by:

said annular groove being defined by a circumferential surface substantially concentric with the axis of said barrel and by a pair of laterally spaced annular undercuts; and said band comprising a closed annulus disposed in contacting relation with said circumferential surface, said annulus being radially contractible and radially contracted about said surface from a diameter greater than the outer surface of said barrel, said arcuate section extending radially from said groove and being flattened radially inward by said shell, and said succession of segments being disposed so that adjacent segments are overlapping and said slots are substantially closed.

2. The invention as recited in claim 1 wherein said band includes a substantially flat margin joining each lateral edge thereof with the arcuate section, each flat margin and associated edge being received, respectively, in one and the other of the annular undercuts.

3. The invention as recited in claim 1 wherein the slot forming each segment defines a leading edge and a trailing edge relative to the segment, said overlapping of segments comprises the leading edge of each segment riding upwardly onto the trailing edge of its next adjacent succeeding segment as a result of the band being contracted.

4. The invention as recited in claim 1 wherein the slot forming each segment defines a leading edge and a trailing edge relative to the segment, said overlapping of segments comprises both the leading edge and the trailing edge of one segment overlapping, respectively, the trailing edge and the leading edge of its two adjacent segments.

5. In combination, mated plug and receptacle members, a duality of mated contacts and a metallic annular spring band therebetween, said plug member including an annular groove therearound and sized to enter said receptacle member, said spring band being seated in said annular groove and including an arcuate section medially of its edges and a plurality of alternating slots therein opening along the opposite edges thereof to define alternating segments, the improvement which comprises:

said annular groove including laterally spaced lips which define, respectively, laterally spaced annular undercuts; and said spring band being radially contractible from a diameter greater than the outer diameter of said plug member so that when the band is contracted its segments overlappingly fold over one onto the other to thereby close said slots.

6. The invention as recited in claim 5 wherein said spring band has flat margins which extend from said arcuate section and terminate in the opposite edges, the opposite edges of the band abutting one or the other of the annular undercuts.

7. A spring band for shielding electromagnetic signals from entering or leaving a connector assembly including a duality of electrical contacts, the assembly being of the type comprising a plug connector mated to a receptacle connector, and an annular groove on the plug connector being circumposed by an inner wall on the receptacle connector, the spring band being characterized by:

a closed, radially contractible, annular band, said band having an uncontracted diameter greater than that of said plug connector and adapted to radially contract into the annular groove, said band having flat margins, an arcuate section medially of the margins, and a plurality of alternating slots opening along the opposite edges to define a succession of segments, radial contraction of the band annulus about and into the annular groove causing the segments to overlap and the slots to substantially close circumferentially.

8. The invention as recited in claim 7 wherein the slot between each pair of adjacent segments defines a trailing edge for one of the segments and a leading edge for the other segment, the overlapping causing the leading edge of said one segment to ride up onto the trailing edge of said other segment.

9. The invention as recited in claim 7 wherein the slot between each pair of adjacent segments defines a trailing edge for one of the segments and a leading edge for the other segment, the overlapping causing both the leading edge and the trailing edge of one said segment to ride above the trailing edge of both the preceding adjacent segment and the leading edge of the succeeding adjacent segment.

10. A method of shielding an electrical connector assembly from electromagnetic interference, said assembly comprising a pair of mateable connector shells with one shell having spaced radial walls defining an annular groove therearound and the other shell being adapted to telescope therearound, the steps of the method being characterized by:

forming an annular undercut in each of the radial walls forming the annular groove;

stamping a spring band from a sheet of metal, the spring band having opposite ends, lateral edges and alternating slots opening along opposite edges thereof to define a succession of alternating segments;

forming the band whereby a midsection of the band has an arcuate cross-section;

joining the opposite ends of the band together to form a closed, radial contractible, annulus of a diameter greater than that of the one shell;

inserting one of the lateral edges of the band annulus into one undercut, said inserting comprising contracting that lateral edge of the annulus radially inward towards the one shell and into the groove;

inserting the other of the lateral edges of the band annulus into the other undercut, said inserting comprising contracting that lateral edge of the annulus radially inward towards the one shell and into the groove, radial contraction of the spring annulus disposing the opposite lateral edges in spaced relation from their respective undercut and succeeding segments to be in overlapping relation, the overlapping of segments causing the associated slots between each adjacent pair of segments to be closed; and mating the other shell with the one shell whereby the other shell radially compresses the arcuate section inwardly about the one shell and drives the lateral edges into abutment with the undercuts.

11. The method as recited in claim 10 wherein the forming step further comprises providing substantially flat margins on each side of the arcuate section which terminate at each lateral edge, the flat margins contacting the annular groove and extending into each of the respective annular undercuts.

* * * * *